US009691333B2

(12) United States Patent
Cheng et al.

(10) Patent No.: US 9,691,333 B2
(45) Date of Patent: Jun. 27, 2017

(54) ELECTROPHORETIC DISPLAY AND METHOD OF OPERATING AN ELECTROPHORETIC DISPLAY

(71) Applicant: SiPix Technology, Inc., Taoyuan (TW)

(72) Inventors: Hsiao-Lung Cheng, Taoyuan County (TW); Ju-Lin Chung, Taoyuan County (TW); Wei-Min Sun, Taipei (TW); Chi-Mao Hung, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 514 days.

(21) Appl. No.: 14/173,819

(22) Filed: Feb. 6, 2014

(65) Prior Publication Data

US 2014/0218277 A1 Aug. 7, 2014

(30) Foreign Application Priority Data

Feb. 7, 2013 (TW) ..... 102104853 A

(51) Int. Cl.
*G09G 3/34* (2006.01)

(52) U.S. Cl.
CPC ..... *G09G 3/344* (2013.01); *G09G 2310/06* (2013.01)

(58) Field of Classification Search
CPC ... G09G 2320/0214; G09G 2320/0257; G09G 2320/0266; G09G 2320/00; G09G 2320/02; G09G 2320/0209; G09G 3/344; G09G 2310/06; G09G 2300/0426; G09G 2300/0847; G09G 2310/04; G09G 2330/023; G09G 2380/14; G09G 5/363; G02F 1/167; G06F 1/32; G06F 1/3265; G06F 3/14; Y02B 60/1242
See application file for complete search history.

(56) References Cited

U.S. PATENT DOCUMENTS

| | | | | |
|---|---|---|---|---|
| 7,701,436 | B2 | 4/2010 | Miyasaka | |
| 2007/0206262 | A1* | 9/2007 | Zhou | G09G 3/344 359/267 |
| 2008/0314652 | A1 | 12/2008 | Kim | |
| 2010/0118046 | A1* | 5/2010 | Miyasaka | G09G 3/344 345/589 |
| 2010/0201657 | A1* | 8/2010 | Miyazaki | G09G 3/344 345/205 |
| 2011/0131094 | A1 | 6/2011 | Chuang | |

(Continued)

FOREIGN PATENT DOCUMENTS

| | | |
|---|---|---|
| CN | 1797165 A | 7/2006 |
| CN | 101556767 A | 10/2009 |

(Continued)

*Primary Examiner* — Nelson Rosario
(74) *Attorney, Agent, or Firm* — Winston Hsu

(57) ABSTRACT

An electrophoretic display includes an electrophoretic panel, a substrate, and a processor. The electrophoretic panel includes a plurality of charged particles. A conductive layer is deposed on the substrate, and the conductive layer is coupled to the electrophoretic panel. The processor is coupled to the conductive layer for generating a background signal to drive the plurality of charged particles to display a background and a foreground signal to drive the plurality of charged particles to display a foreground. The background signal is longer than a period for the foreground signal displaying the foreground.

19 Claims, 13 Drawing Sheets

(56) References Cited

U.S. PATENT DOCUMENTS

| | | | | |
|---|---|---|---|---|
| 2011/0216055 | A1 | 9/2011 | Chiu | |
| 2011/0255145 | A1* | 10/2011 | Masuzawa | G02F 1/167 359/296 |
| 2012/0038687 | A1 | 2/2012 | Lin | |

FOREIGN PATENT DOCUMENTS

| | | | |
|---|---|---|---|
| CN | 101819752 | A | 9/2010 |
| CN | 102262864 | A | 11/2011 |
| TW | 201120738 | A1 | 6/2011 |
| TW | 201131534 | A1 | 9/2011 |

* cited by examiner

ELECTROPHORETIC DISPLAY AND METHOD OF OPERATING AN ELECTROPHORETIC DISPLAY

BACKGROUND OF THE INVENTION

1. Field of the Invention

The present invention relates to an electrophoretic display and a method of operating an electrophoretic display, and particularly to an electrophoretic display and a method of operating an electrophoretic display that can utilize an electrophoretic panel and a conductive layer which are deposed on the same side of a substrate and utilize a redundant signal of a background signal to eliminate shadows of the electrophoretic display.

2. Description of the Prior Art

Because an electrophoretic display has a well bistable characteristic, the electrophoretic display does not consume power when the electrophoretic display keeps displaying an image. Therefore, in the prior art, the electrophoretic display is very suitable for outdoor display billboards and other applications which does not frequently need to update display contents.

The present, structures of most electrophoretic displays (e.g. E-Tag) are double-layer structure, where an upper layer of the double-layer structure is an electrophoretic panel for displaying images, and a bottom layer of the double-layer structure is a driving circuit layer. The driving circuit layer does not have a flat surface if the driving circuit layer is not processed by a special plane process, resulting in the electrophoretic panel having some stress concentration areas. Because operation of an electrophoretic panel is based on electric field, the electrophoretic panel may display shadows on stress concentration areas. Therefore, an electrophoretic display with double-layer structure provided by the prior art is not a good design structure.

SUMMARY OF THE INVENTION

An embodiment provides an electrophoretic display. The electrophoretic display includes an electrophoretic panel, a substrate, and a processor. The electrophoretic panel includes a plurality of charged particles. The substrate is used for deposing a conductive layer, where the conductive layer is coupled to the electrophoretic panel. The processor is coupled to the conductive layer for generating a background signal to drive the plurality of charged particles to display a background and a foreground signal to drive the plurality of charged particles to display a foreground, where the background signal is longer than a period for the foreground signal displaying the foreground.

Another embodiment provides a method of operating an electrophoretic display. The electrophoretic display includes an electrophoretic panel, a substrate, and a processor, where the electrophoretic panel includes a plurality of charged particles. The method includes the processor simultaneously generating a background signal to drive the plurality of charged particles to display a background and a foreground signal to drive the plurality of charged particles to display a foreground; and the processor keeping generating the background signal and the foreground signal with a voltage equal to a common voltage of the electrophoretic panel after the processor completes to generate the foreground signal to display the foreground.

The present invention provides an electrophoretic display and a method for operating an electrophoretic display. The electrophoretic display and the method utilize an electrophoretic panel and a conductive layer that are deposed on the same side of a substrate, utilize a redundant signal of a background signal or a first redundant signal and a second redundant signal of a background signal to make the background signal be longer than a period for a foreground signal displaying a foreground, and utilize a voltage of the foreground signal is equal to a common voltage of the electrophoretic panel after the foreground signal completes to display the foreground. Thus, compared to the prior art, because the electrophoretic panel and the conductive layer are deposed on the same side of the substrate, the electrophoretic panel provided by the present invention not only does not display shadows, but also has simpler process.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
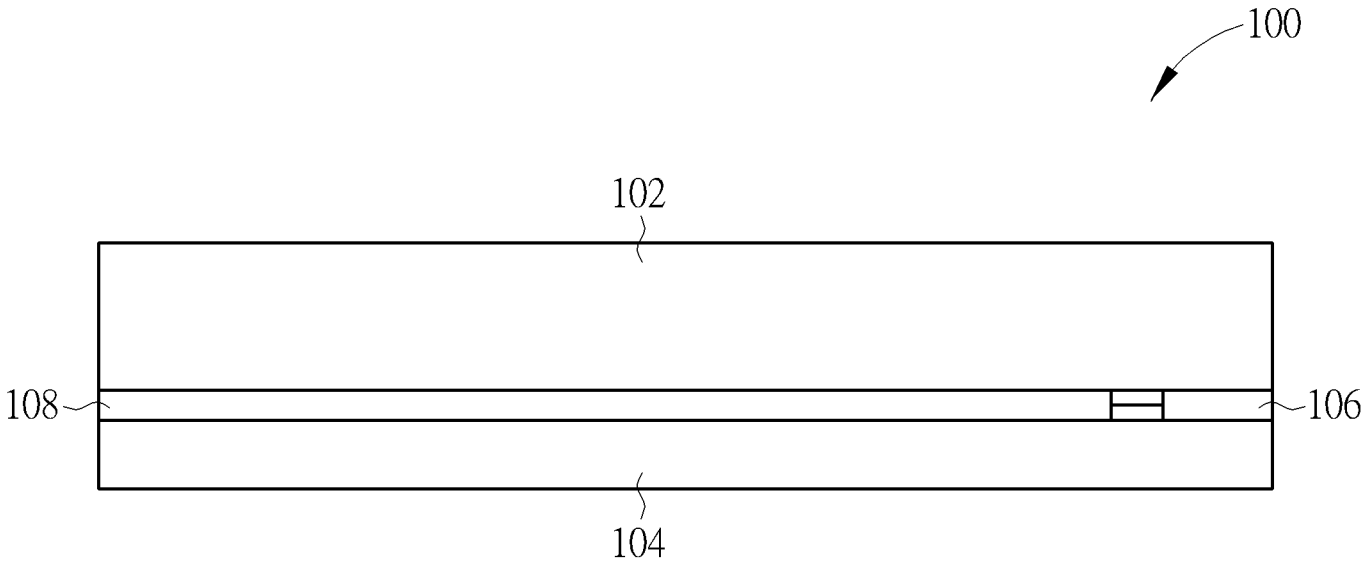
FIG. 1 is a diagram illustrating an electrophoretic display according to an embodiment.

Please refer to FIG. 1. FIG. 1 is a diagram illustrating an electrophoretic display 100 according to an embodiment. The electrophoretic display 100 includes an electrophoretic panel 102, a substrate 104, and a processor 106. The electrophoretic panel 102 includes a plurality of charged particles, where the plurality of charged particles includes a plurality of charged white particles and a plurality of charged black particles. But, the present invention is not limited to the plurality of charged particles of the electrophoretic panel 102 including the plurality of charged white particles and the plurality of charged black particles. That is to say, in another embodiment of the present invention, the plurality of charged particles of the electrophoretic panel 102 are a plurality of charged white particles. The substrate 104 is used for being deposed a conductive layer 108, where the conductive layer 108 is coupled to the electrophoretic panel 102, and the electrophoretic panel 102 and the conductive layer 108 are deposed on the same side of the substrate 104. The processor 106 is coupled to the conductive layer 108 for generating a background signal to drive the plurality of charged particles within the electrophoretic panel 102 to display a background and a foreground signal to drive the plurality of charged particles within the electrophoretic panel 102 to display a foreground, where the background signal is longer than a period for the foreground signal displaying the foreground. In addition, the substrate 104 is a glass substrate, and width of any wire of the conductive layer 108 within the glass substrate is less than 100 um. But, the present invention is not limited to the substrate 104 being a glass substrate. That is to say, in another embodiment of the present invention, the substrate 104 can also be a polyimide substrate, and width of any wire of the conductive layer 108 within the polyimide substrate is less than 100 um. In addition, because the electrophoretic panel 102 and the conductive layer 108 are deposed on the same side of the substrate 104, the conductive layer 108 includes word lines "E-PAPER" and wires 110 for connecting the word lines "E-PAPER" to the processor 106. In addition, the present invention is not limited to a position of the processor 106 as shown in FIG. 1. That is to say, in another embodiment of the present invention, the processor 106 is deposed on a printed circuit board outside the substrate 104 and the electrophoretic panel 102 (where the printed circuit board is coupled to the substrate 104 and the electrophoretic panel 102), or deposed on a chip on film (COF) coupled to the electrophoretic panel 102.

Figure 2:
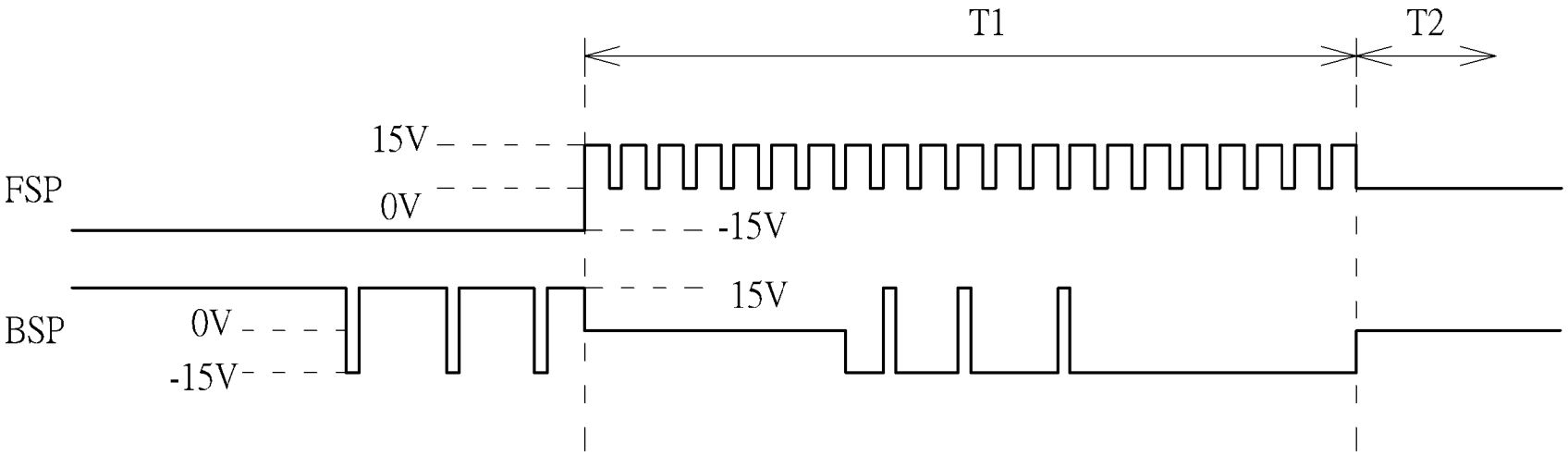
FIG. 2 PRIOR ART
FIG. 2 is a diagram illustrating a background signal generated by the processor for driving the plurality of charged particles of the electrophoretic panel to display a background and a foreground signal generated by the processor for driving the plurality of charged particles of the electrophoretic panel to display a foreground according to the prior art.
Figure 3:
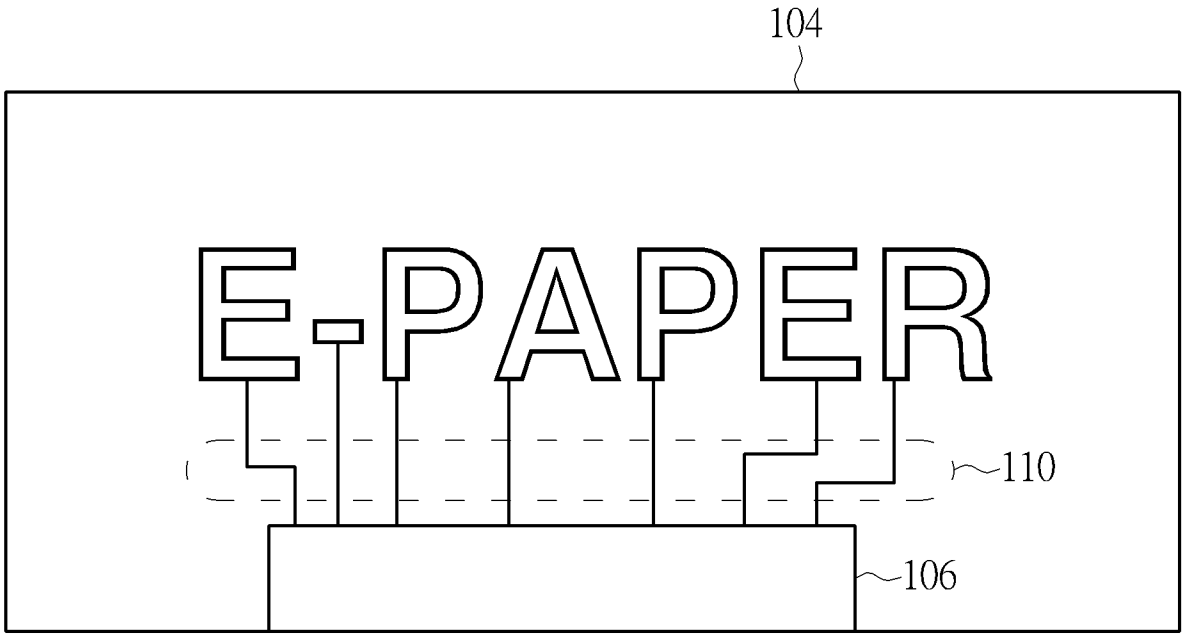
FIG. 3 PRIOR ART
FIG. 3 is a diagram illustrating an image displayed by the electrophoretic panel after the plurality of charged particles of the electrophoretic panel are driven by the background signal and the foreground signal.
Figure 4:
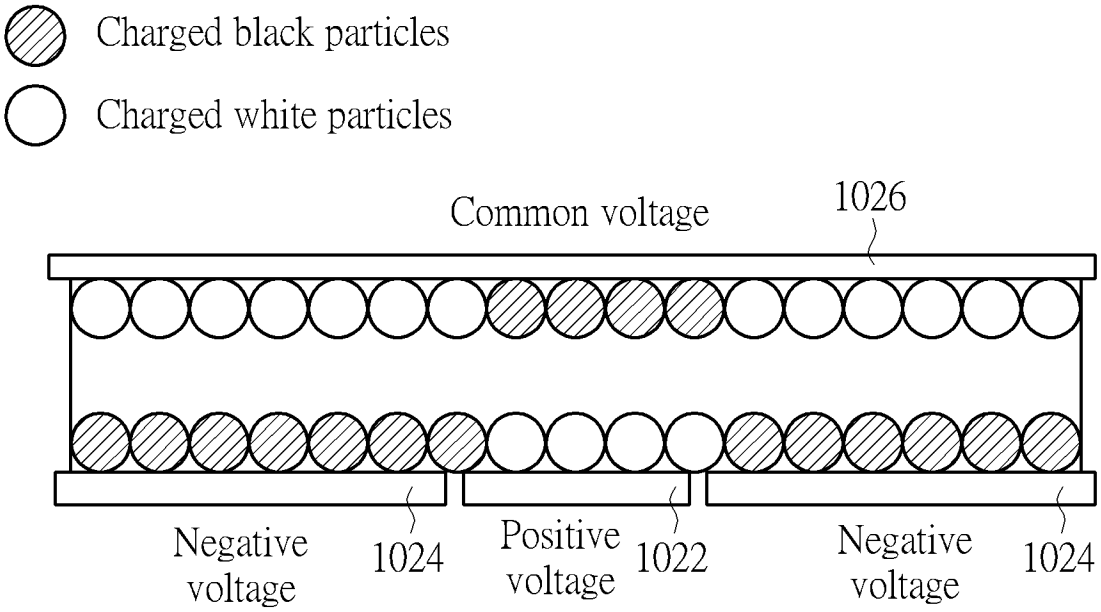
FIG. 4 PRIOR ART
FIG. 4 is a diagram illustrating a principle corresponding to the image (as shown in FIG. 3) displayed by the electrophoretic panel showing the wires.

Please refer to FIG. 2. FIG. 2 is a diagram illustrating a background signal BSP generated by the processor 106 for driving the plurality of charged particles of the electrophoretic panel 102 to display a background and a foreground signal FSP generated by the processor 106 for driving the plurality of charged particles of the electrophoretic panel 102 to display a foreground according to the prior art, where length of the background signal BSP is equal to a period for the foreground signal FSP displaying the foreground. That is to say, the length of the background signal BSP and the period for the foreground signal FSP displaying the foreground are a period T1, and a voltage of the foreground signal FSP is equal to a common voltage (e.g. 0V) of the electrophoretic panel 102 after the foreground signal FSP displays the foreground (that is, after the period T1). Please refer to FIG. 3 and FIG. 4, FIG. 3 is a diagram illustrating an image displayed by the electrophoretic panel 102 after the plurality of charged particles of the electrophoretic panel 102 are driven by the background signal BSP and the foreground signal FSP, and FIG. 4 is a diagram illustrating a principle corresponding to the image (as shown in FIG. 3) displayed by the electrophoretic panel 102 showing the wires 110. In an embodiment of the present invention, the charged write particles within electrophoretic panel 102 have negative charge, and the charged black particles within electrophoretic panel 102 have positive charge. But, the present invention is not limited to the charged write particles within electrophoretic panel 102 having negative charge, and the charged black particles within electrophoretic panel 102 having positive charge. That is to say, the charged write particles within electrophoretic panel 102 also have positive charge, and the charged black particles within electrophoretic panel 102 also have negative charge. In addition, as shown in FIG. 4, a bottom board 1022 of the electrophoretic panel 102 corresponding to the word lines "E-PAPER" and the wires 110 receives a positive voltage (provided by the foreground signal FSP), bottom boards 1024 of the electrophoretic panel 102 non-corresponding to the word lines "E-PAPER" and the wires 110 receives s negative voltage (provided by the background signal BSP), and an upper board 1026 of the electrophoretic panel 102 receives the common voltage. Therefore, as shown in FIG. 3, after the plurality of charged particles of the electrophoretic panel 102 are driven by the background signal BSP and the foreground signal FSP as shown in FIG. 2, the electrophoretic panel 102 not only can display a word "E-PAPER", but can also display the wires 110.

Figure 5:
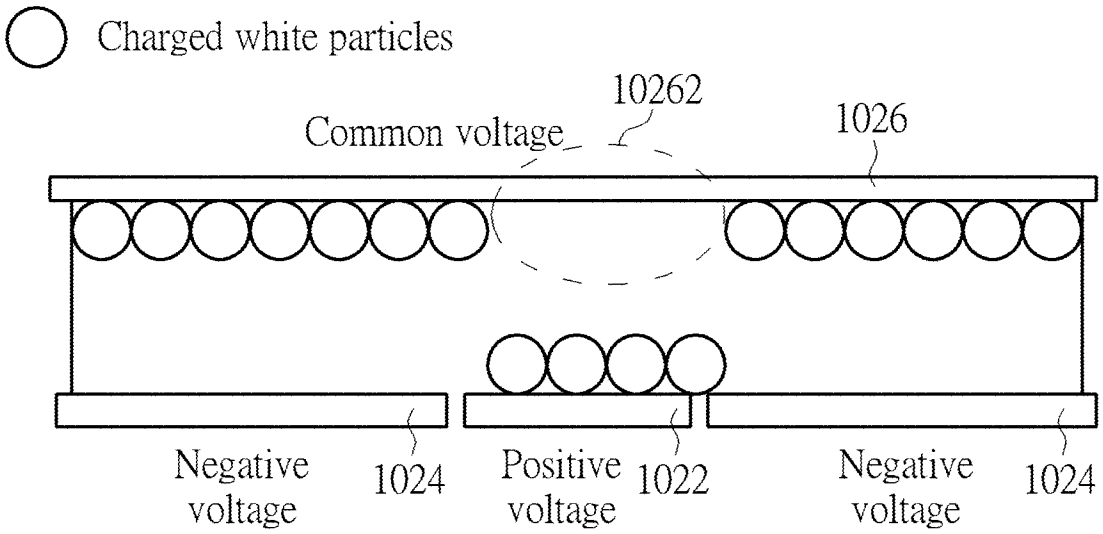
FIG. 5 PRIOR ART
FIG. 5 is a diagram illustrating a non-charged write particle area of the upper board of the electrophoretic panel.

Because the bottom board 1022 of the electrophoretic panel 102 corresponding to the word lines "E-PAPER" and the wires 110 receives the positive voltage (provided by the foreground signal FSP), the bottom boards 1024 of the electrophoretic panel 102 non-corresponding to the word lines "E-PAPER" and the wires 110 receives the negative voltage (provided by the background signal BSP), and the upper board 1026 of the electrophoretic panel 102 receives the common voltage, the electrophoretic panel 102 displays the word "E-PAPER" and the wires 110 (charged black particles near the upper board 1026 of the electrophoretic panel 102 as shown in FIG. 4). That is to say, the charged black particles near the upper board 1026 of the electrophoretic panel 102 as shown in FIG. 4 can make the electrophoretic panel 102 display the word "E-PAPER" and the wires 110, where width of the word lines "E-PAPER" is larger than width (less than 100 um) of the wires 110. In addition, in another embodiment of the present invention, although the plurality of charged particles within the electrophoretic panel 102 are a plurality of charged white particles, because the charged write particles can be attracted by the positive voltage (provided by the foreground signal FSP) received by the bottom board 1022 of the electrophoretic panel 102, the electrophoretic panel 102 can still display the word "E-PAPER" and the wires 110 (a non-charged write particle area 10262 of the upper board 1026 of the electrophoretic panel 102 as shown in FIG. 5).

Figures 6, 7, 8:
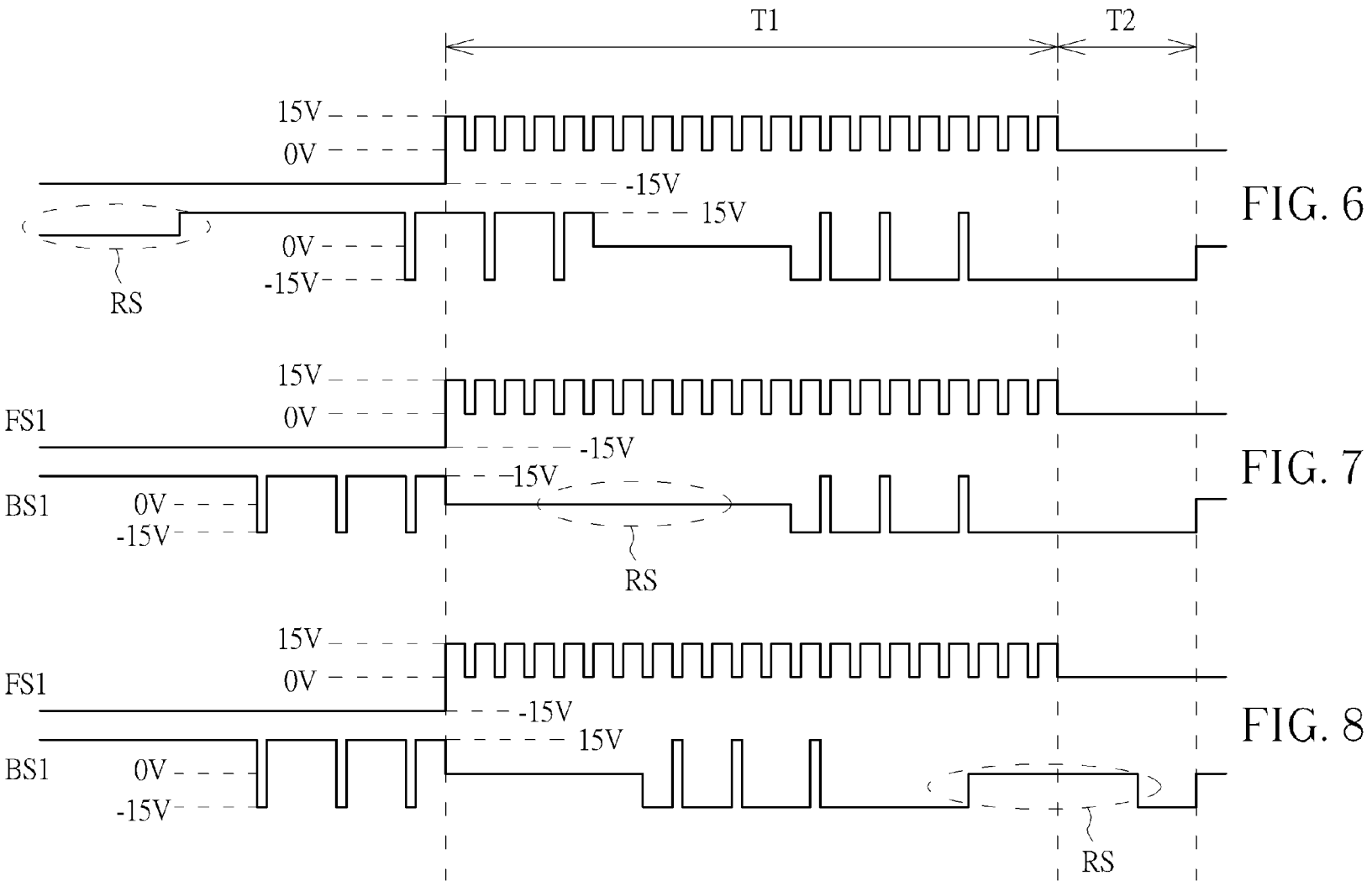
FIG. 6 is a diagram illustrating a background signal generated by the processor for driving the plurality of charged particles of the electrophoretic panel to display a background and a foreground signal generated by the processor for driving the plurality of charged particles of the electrophoretic panel to display a foreground according to another embodiment.
FIG. 7 and FIG. 8 are diagrams illustrating the redundant signal.

Please refer to FIG. 6. FIG. 6 is a diagram illustrating a background signal BS1 generated by the processor 106 for driving the plurality of charged particles of the electrophoretic panel 102 to display a background and a foreground signal FS1 generated by the processor 106 for driving the plurality of charged particles of the electrophoretic panel 102 to display a foreground according to another embodiment, where length of the background signal BS1 is longer than a period for the foreground signal FS1 displaying the foreground. That is to say, the period for the foreground signal FS1 displaying the foreground is equal to a period T1, the length of the background signal BS1 is equal to a sum of the period T1 and a period T2, a voltage of the foreground signal FS1 is equal to the common voltage (e.g. 0V) of the electrophoretic panel 102 after the foreground signal FS1 displays the foreground (that is, the period T2), and the background signal BS1 and the foreground signal FS1 generated by the processor 106 have 3 voltages (e.g. 15V, 0V, and −15V). As shown in FIG. 6, a beginning of the background signal BS1 includes a redundant signal RS, where a voltage of the redundant signal RS is equal to the common voltage of the electrophoretic panel 102. But, the present invention is not limited to the beginning of the background signal BS1 including the redundant signal RS. That is to say, in another embodiment of the present invention, the redundant signal RS can be located at any position within the background signal BS1 (e.g. the redundant signal RS is located at a middle position of the background signal BS1 as shown in FIG. 7, and the redundant signal RS is near an end of the background signal BS1 as shown in FIG. 8).

Figure 9:
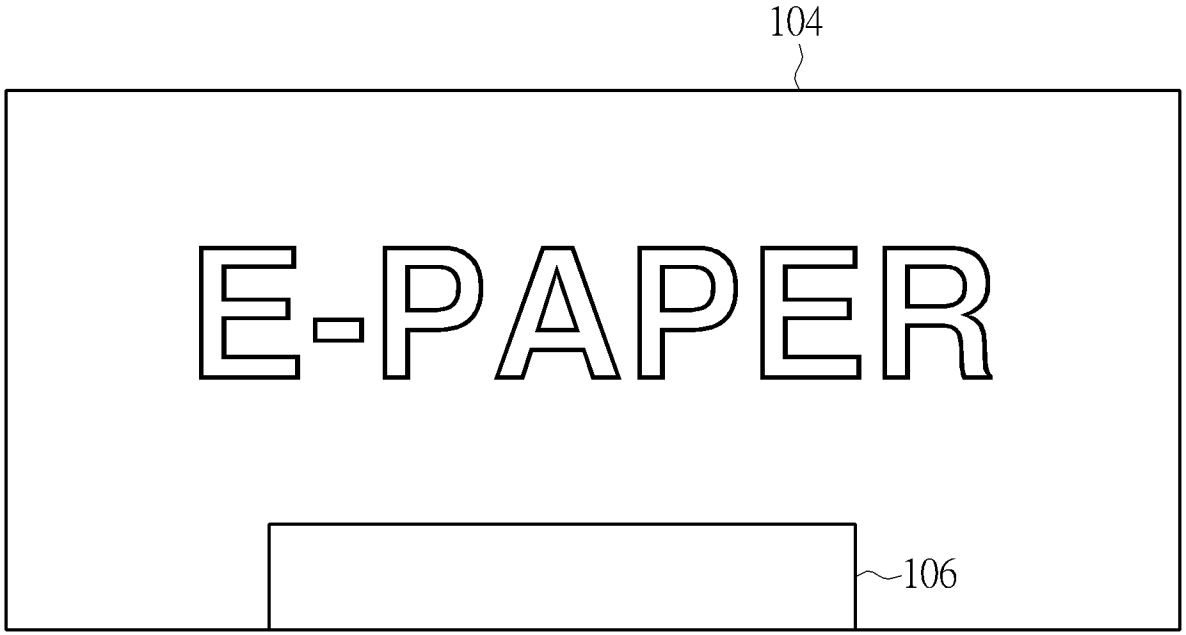
FIG. 9 is a diagram illustrating an image displayed by the electrophoretic panel after the plurality of charged particles of the electrophoretic panel are driven by the background signal and the foreground signal.
Figure 10:
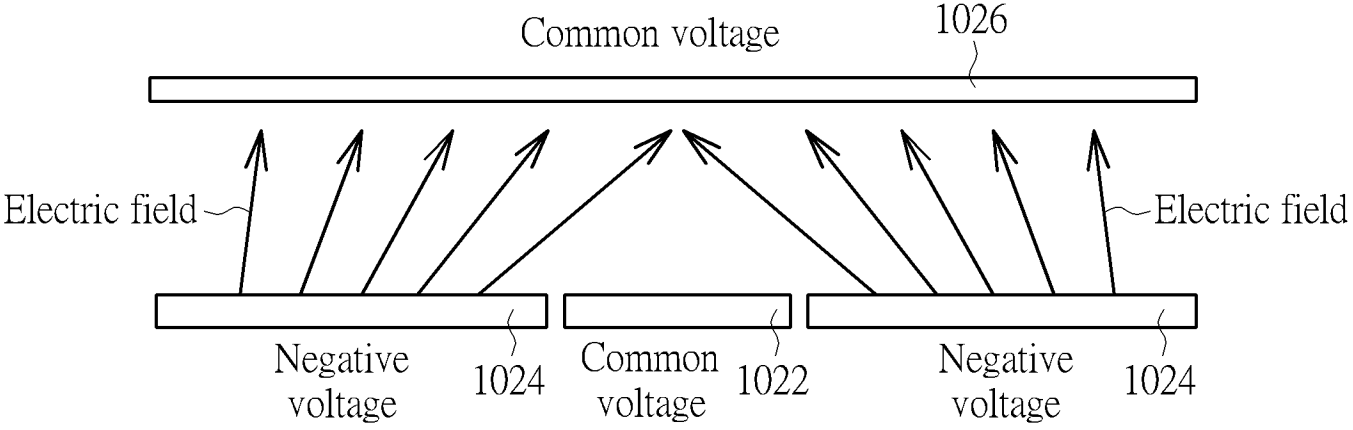
FIG. 10 is a diagram illustrating a principle corresponding to the image (as shown in FIG. 9) displayed by the electrophoretic panel only showing the word lines "E-PAPER" and not showing the wires.
Figure 11:
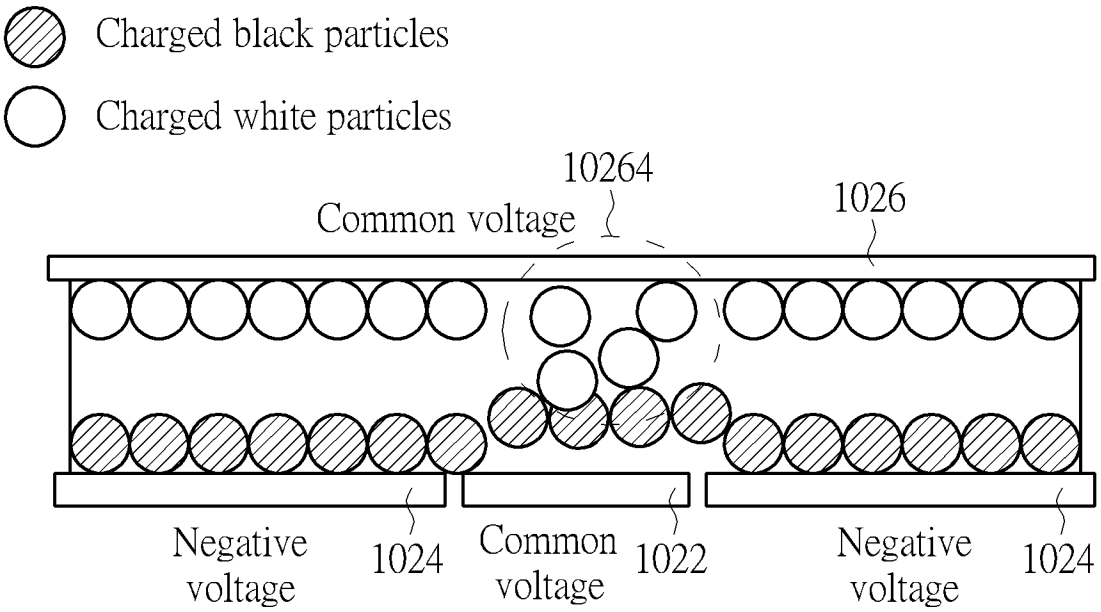
FIG. 11 is a diagram illustrating motion of the plurality of charged particles of the electrophoretic panel at the period after the plurality of charged particles of the electrophoretic panel are driven by the background signal and the foreground signal as shown in FIG. 6.

Please refer to FIG. 9 and FIG. 10. FIG. 9 is a diagram illustrating an image displayed by the electrophoretic panel 102 after the plurality of charged particles of the electrophoretic panel 102 are driven by the background signal BS1 and the foreground signal FS1, and FIG. 10 is a diagram illustrating a principle corresponding to the image (as shown in FIG. 9) displayed by the electrophoretic panel 102 only showing the word lines "E-PAPER" and not showing the wires 110. In addition, as shown in FIG. 10, because the voltage of the foreground signal FS1 is equal to the common voltage (e.g. 0V) of the electrophoretic panel 102 after the foreground signal FS1 displays the foreground (that is, the period T2), the bottom board 1022 of the electrophoretic panel 102 corresponding to the word lines "E-PAPER" and the wires 110 receives the common voltage (0V) at the period T2, and the bottom boards 1024 of the electrophoretic panel 102 non-corresponding to the word lines "E-PAPER" and the wires 110 receive the negative voltage (provided by the background signal BS2). Therefore, as shown in FIG. 10, at the period T2, electric field generated by the negative voltage of the bottom boards 1024 of the electrophoretic panel 102 can be toward the top of the bottom board 1022 of the electrophoretic panel 102 (because the bottom board 1022 of the electrophoretic panel 102 receives the common voltage (0V) at the period T2). Please refer to FIG. 11. FIG. 11 is a diagram illustrating motion of the plurality of charged particles of the electrophoretic panel 102 at the period T2 after the plurality of charged particles of the electrophoretic panel 102 are driven by the background signal BS1 and the foreground signal FS1 as shown in FIG. 6. As shown in FIG. 11, at the period T2, the charged write particles can be pushed by the electric field generated by the negative voltage of the bottom boards 1024 of the electrophoretic panel 102 toward the upper board 1026 of the electrophoretic panel 102, resulting in the electrophoretic panel 102 not displaying the wires 110 (a charged write particle area 10264 of the upper board 1026 of the electrophoretic panel 102 as shown in FIG. 11).

Figure 12:
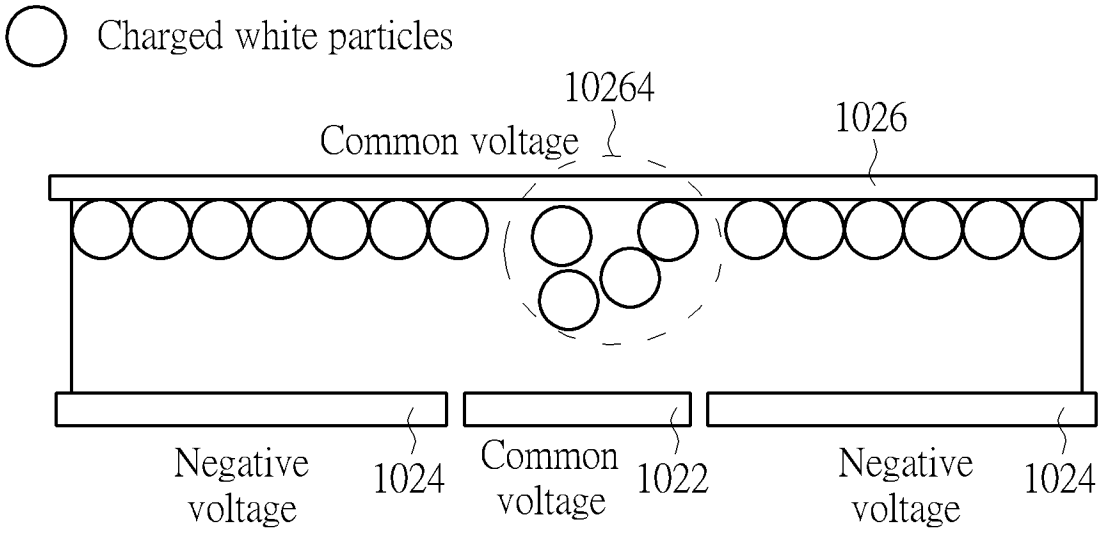
FIG. 12 is a diagram illustrating the charged write particle area of the upper board of the electrophoretic panel.

Similarly, in another embodiment of the present invention, although the plurality of charged particles of the electrophoretic panel 102 are the plurality of charged white particles, the charged write particles can be pushed by the electric field generated by the negative voltage of the bottom boards 1024 of the electrophoretic panel 102 toward the upper board 1026 of the electrophoretic panel 102 at the period T2, resulting in the electrophoretic panel 102 not displaying the wires 110 (the charged write particle area 10264 of the upper board 1026 of the electrophoretic panel 102 as shown in FIG. 12).

Figure 13:
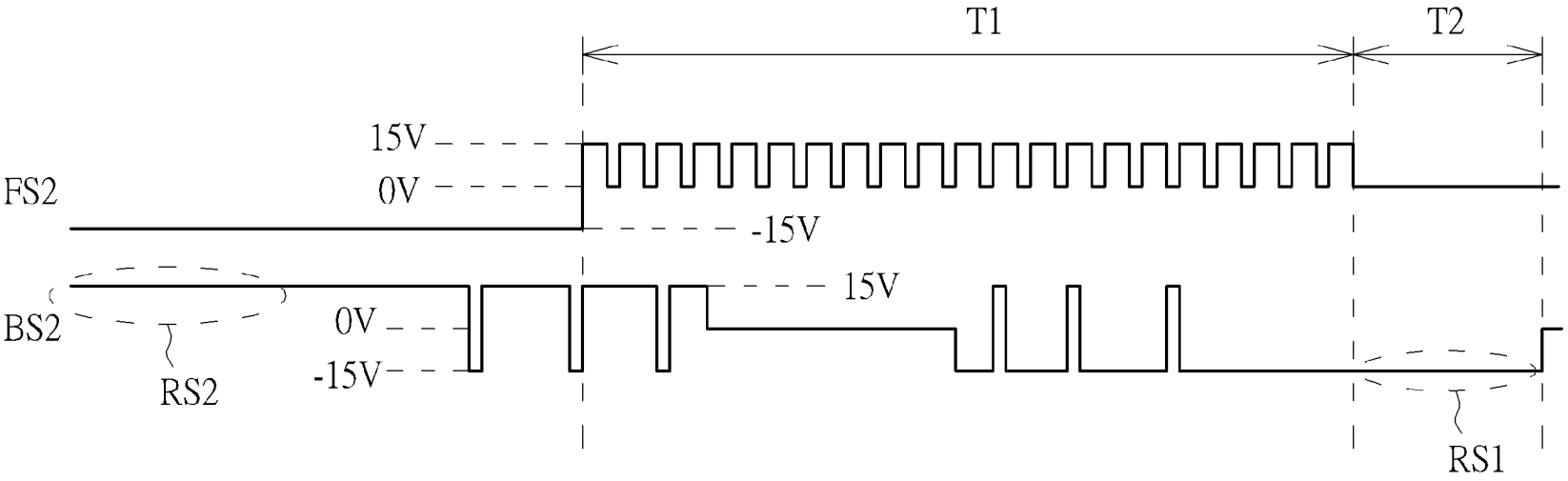
FIG. 13 is a diagram illustrating a background signal generated by the processor for driving the plurality of charged particles of the electrophoretic panel to display a background and a foreground signal generated by the processor for driving the plurality of charged particles of the electrophoretic panel to display a foreground according to another embodiment.

Please refer to FIG. 13. FIG. 13 is a diagram illustrating a background signal BS2 generated by the processor 106 for driving the plurality of charged particles of the electrophoretic panel 102 to display a background and a foreground signal FS2 generated by the processor 106 for driving the plurality of charged particles of the electrophoretic panel 102 to display a foreground according to another embodiment, where length of the background signal BS2 is longer than a period for the foreground signal FS2 displaying the foreground. That is to say, the period for the foreground signal FS2 displaying the foreground is equal to a period T1, the length of the background signal BS2 is equal to a sum of the period T1 and a period T2, a voltage of the foreground signal FS2 is equal to the common voltage (e.g. 0V) of the electrophoretic panel 102 after the foreground signal FS2 displays the foreground (that is, the period T2), and the background signal BS2 and the foreground signal FS2 generated by the processor 106 have 3 voltages (e.g. 15V, 0V, and −15V). As shown in FIG. 13, the background signal BS2 includes a first redundant signal RS1 and a second redundant signal RS2, where a voltage of the first redundant signal RS1 is a negative voltage (e.g. −15V) and a voltage of the second redundant signal RS2 is a positive voltage (e.g. 15V), length of the first redundant signal RS1 is equal to length of the second redundant signal RS2, and the first redundant signal RS1 is located at an end of the background signal BS2 and the second redundant signal RS2 is located at any position of the background signal BS2. Because the length of the first redundant signal RS1 is equal to the length of the second redundant signal RS2 and the voltage of the first redundant signal RS1 and the voltage of the second redundant signal RS2 are inverse, the background signal BS2 can maintain electric neutrality of the electrophoretic panel 102. In addition, motion of the plurality of charged particles of the electrophoretic panel 102 can refer to FIG. 11 and FIG. 12 after the plurality of charged particles of the electrophoretic panel 102 are driven by the background signal BS2 and the foreground signal FS2 as shown in FIG. 13.

Figure 14:
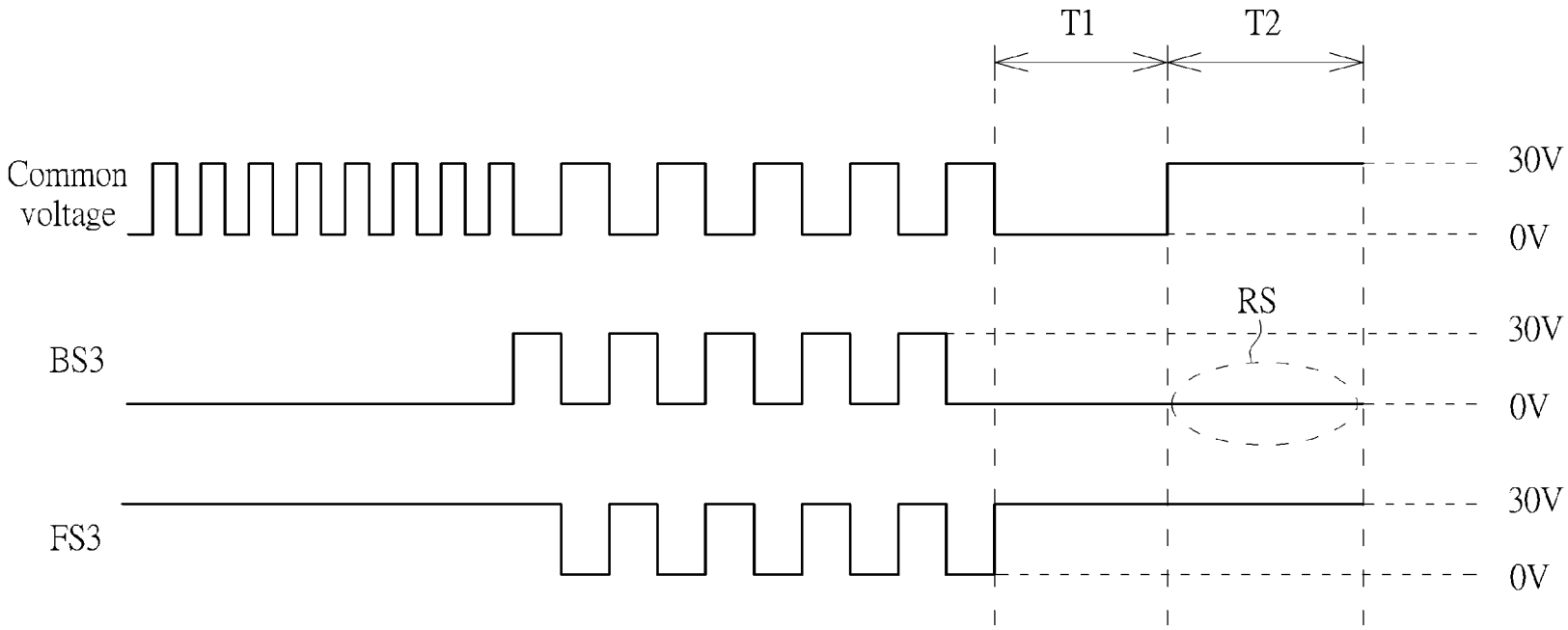
FIG. 14 is a diagram illustrating a background signal generated by the processor for driving the plurality of charged particles of the electrophoretic panel to display a background and a foreground signal generated by the processor for driving the plurality of charged particles of the electrophoretic panel to display a foreground according to another embodiment.

Please refer to FIG. 14. FIG. 14 is a diagram illustrating a background signal BS3 generated by the processor 106 for driving the plurality of charged particles of the electrophoretic panel 102 to display a background and a foreground signal FS3 generated by the processor 106 for driving the plurality of charged particles of the electrophoretic panel 102 to display a foreground according to another embodiment, where length of the background signal BS3 is longer than a period for the foreground signal FS3 displaying the foreground. That is to say, the period for the foreground signal FS3 displaying the foreground is equal to a period T1, the length of the background signal BS3 is equal to a sum of the period T1 and a period T2, a voltage of the foreground signal FS3 is equal to the common voltage (e.g. 30V) of the electrophoretic panel 102 after the foreground signal FS3 displays the foreground (that is, the period T2), and the background signal BS3 and the foreground signal FS3 generated by the processor 106 and the common voltage of the electrophoretic panel 102 have 2 voltages (e.g. 30V and 0V). As shown in FIG. 14, the background signal BS3 includes a redundant signal RS, and a voltage of the redundant signal RS and the common voltage of the electrophoretic panel 102 are inverse, where the redundant signal RS is located at an end of the background signal BS3. In addition, as shown in FIG. 14, the voltage of the foreground signal FS3 is equal to the common voltage of the electrophoretic panel 102 during the redundant signal RS (the period T2), that is, the voltage of the foreground signal FS3 and the common voltage of the electrophoretic panel 102 are 30V. In addition, motion of the plurality of charged particles of the electrophoretic panel 102 can refer to FIG. 11 and FIG. 12 after the plurality of charged particles of the electrophoretic panel 102 are driven by the background signal BS3 and the foreground signal FS3 as shown in FIG. 14.

Figure 15:
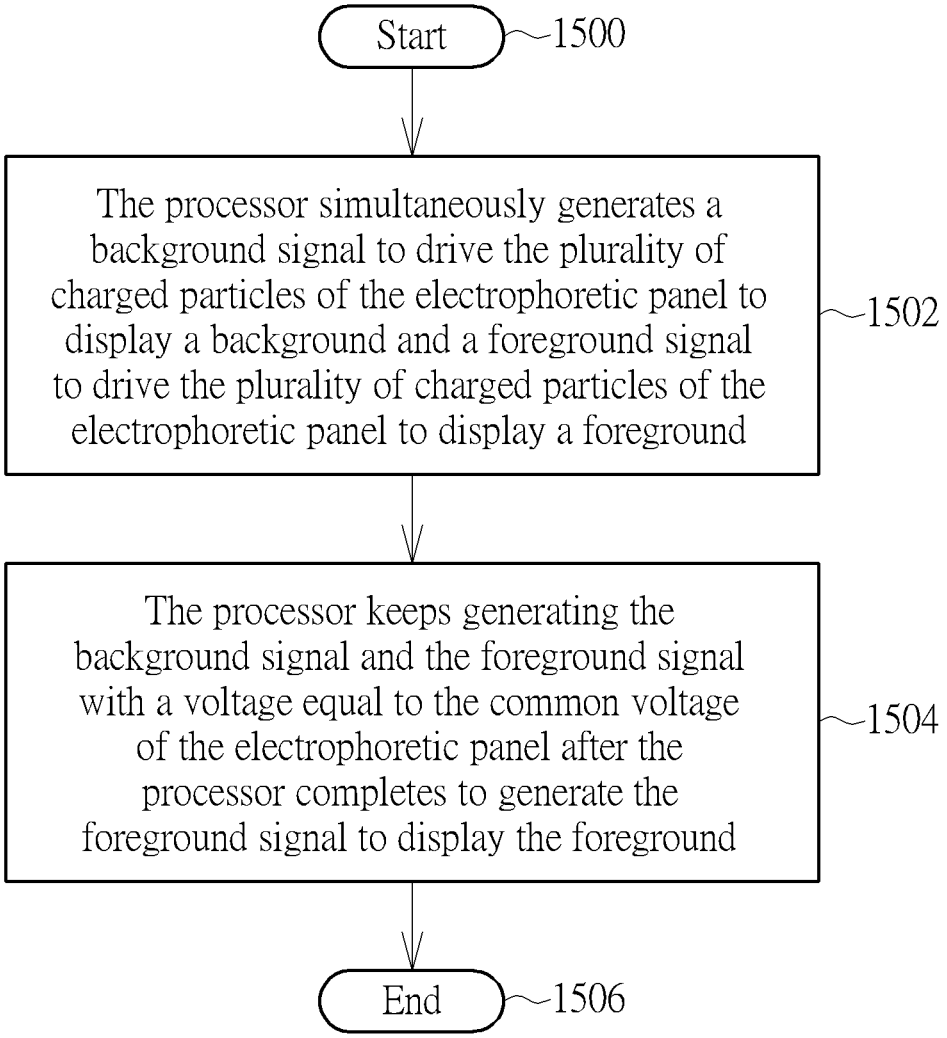
FIG. 15 is a flowchart illustrating a method of operating an electrophoretic display according to another embodiment.

Please refer to FIG. 1, FIG. 6 to FIG. 15. FIG. 15 is a flowchart illustrating a method of operating an electrophoretic display according to another embodiment. The method in FIG. 15 is illustrated using the display 100 in FIG. 1. Detailed steps are as follows:

Step 1500: Start.

Step 1502: The processor 106 simultaneously generates a background signal to drive the plurality of charged particles of the electrophoretic panel 102 to display a background and a foreground signal to drive the plurality of charged particles of the electrophoretic panel 102 to display a foreground.

Step 1504: The processor 106 keeps generating the background signal and the foreground signal with a voltage equal to the common voltage of the electrophoretic panel 102 after the processor 106 completes to generate the foreground signal to display the foreground.

Step 1506: End.

Take FIG. 6 as an example.

In Step 1502, the processor 106 simultaneously generates the background signal BS1 to drive the plurality of charged particles of the electrophoretic panel 102 to display the background and the foreground signal FS1 to drive the plurality of charged particles of the electrophoretic panel 102 to display the foreground. In Step 1504, the processor 106 keeps generating the background signal BS1 and the foreground signal FS1 with the voltage equal to the common voltage of the electrophoretic panel 102 after the processor 106 completes to generate the foreground signal FS1 to display the foreground. Therefore, as shown in FIG. 6, the length of the background signal BS1 is longer than the period for the foreground signal FS1 displaying the foreground. That is to say, the period for the foreground signal FS1 displaying the foreground is equal to the period T1, the length of the background signal BS1 is equal to the sum of the period T1 and the period T2, the voltage of the foreground signal FS1 is equal to the common voltage (e.g. 0V) of the electrophoretic panel 102 after the foreground signal FS1 displays the foreground (that is, the period T2), and the background signal BS1 and the foreground signal FS1 generated by the processor 106 have 3 voltages (e.g. 15V, 0V, and −15V). As shown in FIG. 6, the beginning of the background signal BS1 includes the redundant signal RS, where the voltage of the redundant signal RS is equal to the common voltage of the electrophoretic panel 102. But, the present invention is not limited to the beginning of the background signal BS1 including the redundant signal RS. That is to say, in another embodiment of the present invention, the redundant signal RS can be located at any position within the background signal BS1 (the redundant signal RS is located at a middle position of the background signal BS1 as shown in FIG. 7, and the redundant signal RS is near an end of the background signal BS1 as shown in FIG. 8). In addition, motion of the plurality of charged particles of the electrophoretic panel 102 can refer to FIG. 11 and FIG. 12 after the plurality of charged particles of the electrophoretic panel 102 are driven by the background signal BS1 and the foreground signal FS1 as shown in FIG. 6.

Take FIG. 13 as an example.

In Step 1502, the processor 106 simultaneously generates the background signal BS2 to drive the plurality of charged particles of the electrophoretic panel 102 to display the background and the foreground signal FS2 to drive the plurality of charged particles of the electrophoretic panel 102 to display the foreground. In Step 1504, the processor 106 keeps generating the background signal BS2 and the foreground signal FS2 with the voltage equal to the common voltage of the electrophoretic panel 102 after the processor 106 completes to generate the foreground signal FS2 to display the foreground. Therefore, as shown in FIG. 13, the length of the background signal BS2 is longer than the period for the foreground signal FS2 displaying the foreground. That is to say, the period for the foreground signal FS2 displaying the foreground is equal to the period T1, the length of the background signal BS2 is equal to the sum of the period T1 and the period T2, the voltage of the foreground signal FS2 is equal to the common voltage (e.g. 0V) of the electrophoretic panel 102 after the foreground signal FS2 displays the foreground (that is, the period T2), and the background signal BS2 and the foreground signal FS2 generated by the processor 106 have 3 voltages (e.g. 15V, 0V, and −15V). As shown in FIG. 13, the background signal BS2 includes the first redundant signal RS1 and the second redundant signal RS2, where the voltage of the first redundant signal RS1 is the negative voltage (e.g. −15V) and the voltage of the second redundant signal RS2 is the positive voltage (e.g. 15V), the length of the first redundant signal RS1 is equal to the length of the second redundant signal RS2, and the first redundant signal RS1 is located at the end of the background signal BS2 and the second redundant signal RS2 is located at any position of the background signal BS2. Because the length of the first redundant signal RS1 is equal to the length of the length of the second redundant signal RS2 and the voltage of the first redundant signal RS1 and the voltage of the second redundant signal RS2 are inverse, the background signal BS2 can maintain electric neutrality of the electrophoretic panel 102. In addition, motion of the plurality of charged particles of the electrophoretic panel 102 can refer to FIG. 11 and FIG. 12 after the plurality of charged particles of the electrophoretic panel 102 are driven by the background signal BS2 and the foreground signal FS2 as shown in FIG. 13.

Take FIG. 14 as an example.

In Step 1502, the processor 106 simultaneously generates the background signal BS3 to drive the plurality of charged particles of the electrophoretic panel 102 to display the background and the foreground signal FS3 to drive the plurality of charged particles of the electrophoretic panel 102 to display the foreground. In Step 1504, the processor 106 keeps generating the background signal BS3 and the foreground signal FS3 with the voltage equal to the common voltage of the electrophoretic panel 102 after the processor 106 completes to generate the foreground signal FS3 to display the foreground. Therefore, as shown in FIG. 14, the length of the background signal BS3 is longer than the period for the voltage of the foreground signal FS3 displaying the foreground. That is to say, the period for the voltage of the foreground signal FS3 displaying the foreground is equal to the period T1, the length of the background signal BS3 is equal to the sum of the period T1 and the period T2, the voltage of the foreground signal FS3 is equal to the common voltage (e.g. 30V) of the electrophoretic panel 102 after the foreground signal FS3 displays the foreground (that is, the period T2), and the background signal BS3 and the foreground signal FS3 generated by the processor 106 and the common voltage of the electrophoretic panel 102 have 2 voltages (e.g. 30V and 0V). As shown in FIG. 14, the background signal BS3 includes the redundant signal RS and the voltage of the redundant signal RS and the common voltage of the electrophoretic panel 102 are inverse, where the redundant signal RS is located at the end of the background signal BS3. In addition, as shown in FIG. 14, the voltage of the foreground signal FS3 is equal to the common voltage of the electrophoretic panel 102 during the redundant signal RS (the period T2), that is, the voltage of the foreground signal FS3 and the common voltage of the electrophoretic panel 102 are 30V. In addition, motion of the plurality of charged particles of the electrophoretic panel 102 can refer to FIG. 11 and FIG. 12 after the plurality of charged particles of the electrophoretic panel 102 are driven by the background signal BS3 and the foreground signal FS3 as shown in FIG. 14.

To sum up, the electrophoretic display and the method for operating the electrophoretic display utilize the electrophoretic panel and the conductive layer that are deposed on the same side of the substrate, utilize the redundant signal of the background signal or the first redundant signal and the second redundant signal of the background signal to make the background signal be longer than the period for the foreground signal displaying the foreground, and utilize the voltage of the foreground signal is equal to the common voltage of the electrophoretic panel after the foreground signal completes to display the foreground. Thus, compared to the prior art, because the electrophoretic panel and the conductive layer are deposed on the same side of the substrate, the electrophoretic panel provided by the present invention not only does not display shadows, but also has simpler process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrophoretic display, comprising:

an electrophoretic panel comprising a plurality of charged particles;

a substrate for deposing a conductive layer, wherein the conductive layer is coupled to the electrophoretic panel; and a processor coupled to the conductive layer for generating a background signal to drive the plurality of charged particles to display a background and a foreground signal to drive the plurality of charged particles to display a foreground, wherein a time interval for the background signal displaying the background is longer than a time interval for the foreground signal displaying the foreground;

wherein the background signal and the foreground signal are two voltage signals, the background of the electrophoretic display is a display region driven by the background signal, the foreground of the display is a display region driven by the foreground signal, the background signal and the foreground signal each comprise a first voltage level, a second voltage level, and a third voltage level, the first voltage level is greater than the second voltage level, and the second voltage level is greater than the third voltage level.

2. The electrophoretic display of claim 1, wherein the electrophoretic panel and conductive layer are deposed on the same side of the substrate.

3. The electrophoretic display of claim 1, wherein a voltage of the foreground signal is equal to a common voltage of the electrophoretic panel after the foreground signal completes to display the foreground.

4. The electrophoretic display of claim 3, wherein the background signal comprises a redundant signal, and a voltage of the redundant signal is equal to the common voltage of the electrophoretic panel.

5. The electrophoretic display of claim 3, wherein the background signal comprises a first redundant signal and a second redundant signal, a voltage of the first redundant signal and a voltage of the second redundant signal are inverse, and the first redundant signal is located at an end of the background signal.

6. The electrophoretic display of claim 3, wherein the background signal comprises a redundant signal, and a voltage of the redundant signal and the common voltage of the electrophoretic panel are inverse.

7. The electrophoretic display of claim 6, wherein the redundant signal is located at an end of the background signal.

8. The electrophoretic display of claim 7, wherein a voltage of the foreground signal is equal to the common voltage of the electrophoretic panel during the redundant signal.

9. The electrophoretic display of claim 1, wherein the plurality of charged particles comprise a plurality of charged white particles and a plurality of charged black particles.

10. The electrophoretic display of claim 1, wherein the plurality of charged particles are a plurality of charged white particles.

11. The electrophoretic display of claim 1, wherein the substrate is a glass substrate, and width of any wire of the conductive layer is less than 100 um.

12. The electrophoretic display of claim 1, wherein the substrate is a polyimide substrate, and width of any wire of the conductive layer is less than 100 um.

13. A method of operating an electrophoretic display, the electrophoretic display comprising an electrophoretic panel, a substrate, and a processor, wherein the electrophoretic panel comprises a plurality of charged particles, the method comprising:

the processor simultaneously generating a background signal to drive the plurality of charged particles to display a background and a foreground signal to drive the plurality of charged particles to display a foreground; and the processor continuing to generate the background signal and the foreground signal with a voltage equal to a common voltage of the electrophoretic panel after the foreground signal is used for displaying the foreground during a time interval;

wherein the background signal and the foreground signal are two voltage signals, the background of the electrophoretic display is a display region driven by the background signal, the foreground of the display is a display region driven by the foreground signal, the background signal and the foreground signal each comprise a first voltage level, a second voltage level, and a third voltage level, the first voltage level is greater than the second voltage level, the second voltage level is greater than the third voltage level, and a time interval for the background signal displaying the background is longer than the time interval for the foreground signal displaying the foreground.

14. The method of claim 13, wherein the background signal comprises a redundant signal, and a voltage of the redundant signal is equal to the common voltage of the electrophoretic panel.

15. The method of claim 14, wherein the redundant signal is located at any position within the background signal.

16. The method of claim 14, wherein the background signal comprises a first redundant signal and a second redundant signal, a voltage of the first redundant signal and a voltage of the second redundant signal are inverse, and the first redundant signal is located at an end of the background signal.

17. The method of claim 14, wherein the background signal comprises a redundant signal, and a voltage of the redundant signal and the common voltage of the electrophoretic panel are inverse.

18. The method of claim 17, wherein the redundant signal is located at an end of the background signal.

19. The method of claim 18, wherein a voltage of the foreground signal is equal to the common voltage of the electrophoretic panel during the redundant signal.

* * * * *